United States Patent [19]

Rosenbloom, Jr. et al.

[11] 4,290,468

[45] Sep. 22, 1981

[54] PORTABLE COLLAPSIBLE CONTAINER

[75] Inventors: Percy Rosenbloom, Jr.; Percy Rosenbloom, III, both of Jacksonville, Fla.

[73] Assignee: Technical Materials, Inc., Jacksonville, Fla.

[21] Appl. No.: 94,441

[22] Filed: Nov. 15, 1979

[51] Int. Cl.[3] ..... B65D 33/02

[52] U.S. Cl. ..... 150/49

[58] Field of Search ..... 150/48, 49, 50, 51, 150/0.5, 1; 220/85 K

[56] References Cited

U.S. PATENT DOCUMENTS

| | | | |
|---|---|---|---|
| 841,170 | 1/1907 | Nacht et al. | 150/50 |
| 1,274,764 | 8/1918 | Pedersen | 220/85 K |
| 1,677,583 | 7/1928 | Cromwell | 150/48 |
| 2,150,620 | 3/1939 | Frost | 150/49 |
| 2,600,501 | 6/1952 | Higgs | 150/49 X |
| 2,664,131 | 12/1953 | Miller | 150/49 |
| 4,141,459 | 2/1979 | Eli | 220/85 K |

*Primary Examiner*—Donald F. Norton
*Attorney, Agent, or Firm*—Arthur G. Yeager

[57] ABSTRACT

A portable collapsible container made of flexible material the general form of a thin walled barrel, comprising a cylindrical body portion and a bottom cover removably attached to the lower end of the cylindrical wall; the body portion containing two enclosed hoop members one of which is adjacent the upper end of the cylindrical wall and the other which is spaced apart therefrom, the two hoop members being separated by a plurality of vertical stiffening members enclosed in the wall of said body portion and spaced substantially equidistantly around said wall and disconnected from both hoop members.

20 Claims, 12 Drawing Figures

PORTABLE COLLAPSIBLE CONTAINER

BACKGROUND OF THE INVENTION

This invention relates to portable, flexible, collapsible containers in the nature of trash barrels, and more particularly, those containers which are light in weight, wear resistant, and sufficiently collapsible to fold into small volumes.

The collection and removal of waste paper, cans, bottles, and other materials generally called "trash" is a sufficiently large problem to warrant business organizations that specialize in such matters. In the normal business office there may be a cleaning organization which collects all the trash accumulated during the day's operation and removes it to a suitable place of disposal. Those who are collecting the trash from separate offices normally employ a large container (30–50 gal. in size) for this purpose. In some instances these containers are merely thin flexible plastic bags and in other instances are semi-rigid plastic or metal barrels. Flexible bags can be carried by hand until they are too bulky or too heavy to be conveniently moved about, while semi-rigid barrels are frequently moved on a wheeled cart or "dolly." In close quarters the flexible bag has the advantage of being able to be carried to the vicinity of each individual waste basket that must be emptied without fear of scratching or marring furniture or walls, but on the other hand, it is usually made of sufficiently fragile material that it is easily torn or ripped on sharp corners of desks or the like. The semi-rigid barrel is much more wear resistant than the flexible bag, but it can only be used in close quarters with care because of the possibility of scratching or marring furniture or walls as it is moved about on its cart. There is, therefore, a need for a trash container which incorporates the advantages of both of these types of containers and eliminates as many of the disadvantages as possible.

It is an object of this invention to provide a portable, collapsible container of flexible, wear resistant material. It is another object of this invention to provide a trash container which is so constructed that it will stand alone and yet can be readily collapsed to a very small volume. It is another object of this invention to provide a reusable flexible container which can be dragged along the floor with ease and without fear of tearing. Still other objects of this invention will appear in the more detailed description which follows.

BRIEF DESCRIPTION OF THE DRAWINGS

The novel features believed to be characteristic of this invention are set forth with particularity in the appended claims. The invention, however, both as to its organization and method of operation, together with further objects and advantages thereof, may best be understood by reference to the following description taken in connection with the accompanying drawings in which:

BRIEF DESCRIPTION OF THE INVENTION

Figure 1:
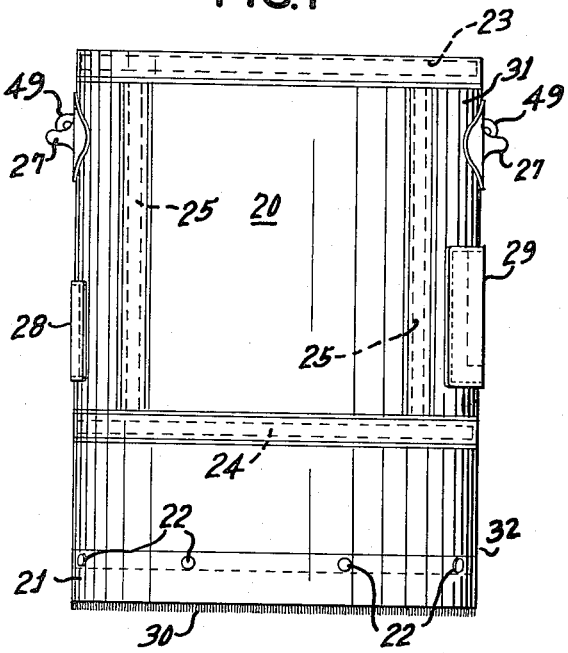
FIG. 1 is a side elevation view of the container of this invention in its fully upstanding condition.

This invention relates to a collapsible flexible container comprising a generally thin walled cylindrical body having an upper end and a lower end made of collapsible flexible sheet material, a removably attachable bottom cover, and fastening means for removably attaching said cover to said lower end of said body, said cover having an outside surface of wear resistant, low friction material; said body enclosing in its wall adjacent said upper end a first circumferential stiff hoop and spaced apart therefrom, intermediate said upper end and said lower end, a second circumferential stiff hoop substantially parallel to said first hoop; said body also enclosing its wall a plurality of spaced, separate, linear stiffening members substantially perpendicular to and separated from said hoops and positioned intermediate said first and second hoops. In specific embodiments of this invention the body of the container is made of plastic such as a laminate of polyvinyl chloride and nylon fiber. In another embodiment of this invention the bottom cover has an outside layer of synthetic fiber carpeting. In still another embodiment of this invention the hoop members and the vertical stiffening members are made of metallic strips.

DETAILED DESCRIPTION OF THE INVENTION

In FIGS. 1–6 the general features of the container of this invention may be seen and understood. The container is made of two pieces which are fastened together. There is a container body 20 which is generally cylindrical in shape and has a thin wall of a flexible sheet material. Preferably this material is a synthetic plastic that is sufficiently tough to resist tearing and puncturing and yet is sufficiently light in weight to be easily carried. Many synthetic plastic materials are suitable for this purpose including polyolefins, polyamides, polyvinyls, and many combinations of these materials. A particularly suitable material which is preferred in this invention is a laminate of polyvinyl chloride and nylon fiber having a thickness of about 2–10 mils, preferably 2–5 mils. The second portion of the container is a bottom cover 21 which is attached to container body 20 by means of fasteners 22. The fasteners need only be ones which are easily operated to attach or to remove cover 21 from body 20. Such a fastener might be a zipper, buttons, snaps, hooks, or any other removably attachable fastening means. A preferred type for this invention is a heavy duty metallic snap fastener. Cover 21 is fabricated to fit over the outside of the wall of container body 20 and has a special wear resistant, low friction material on the outside surface 30 of cover 21. Since the container is expected to be employed by dragging it over floors of various types the material of surface 30 must be durable, wear resistant, and one which will slide easily over any of several type of modern floor coverings. Heavy gauge plastic materials may be employed with or without suitable embossing. A preferred type of covering is one of the many varieties of synthetic fiber carpeting material, a particularly preferred one being made of polypropylene. Similar carpeting made of polyamide, polyester, or other polyolefins is suitable in certain embodiments of this invention.

Container body 20 is provided with unique collapsing characteristics by enclosing in the wall of container body 20 a first circumferential hoop 23 and a second circumferential hoop 24 cooperating with a plurality of spaced vertical stiffening members 25. Hoop members 23 and 24 are made of metal or other stiff flexible material which will retain its circular shape when unrestrained but which can be bent and will flex readily under ordinary manual pressure. Hoop members 23 and 24 are each totally enclosed in a separate tubular pocket built into the wall of container body 20. Vertical stiffening members 25 are made of the same or similar material as hoop members 23 and 24, and are likewise each positioned into separate tubular pockets built into the wall of container body 20. Depending upon the size of the container there may be four or more separate stiffening members 25. There is no connection between stiffening members 25 and either of hoop members 23 and 24; each being completely isolated from any other by its own individual pocket.

Figure 2:
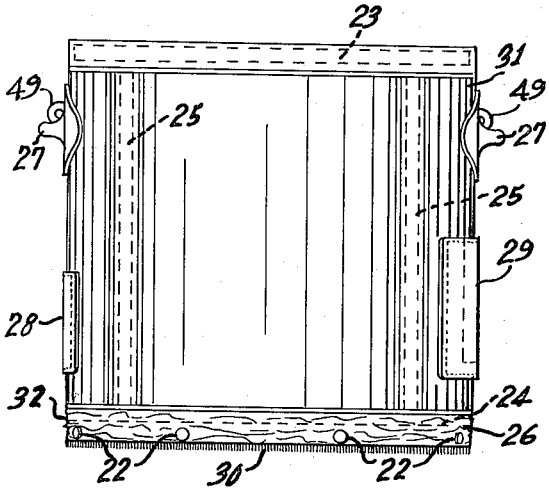
FIG. 2 is a side elevation of the container of this invention in a partially collapsed state.

The construction employing hoop members 23 and 24 along with a plurality of vertical stiffening members 25 permits the portion of container body 20 between hoop members 23 and 24 to maintain an upstanding position as shown in FIG. 2 while the nonstiffened portion 26 collapses upon itself when there is nothing to hold it in its upstanding position as shown in FIG. 1. Until there is sufficient trash collected in the container it will maintain its position shown in FIG. 2, but when sufficient trash is in the container the trash will support second hoop 24 and the container will take the general form of that shown in FIG. 1. Thus the container in its uncollapsed state has a volume which varies between that shown in FIG. 2 and the larger volume shown in FIG. 1.

Figure 3:
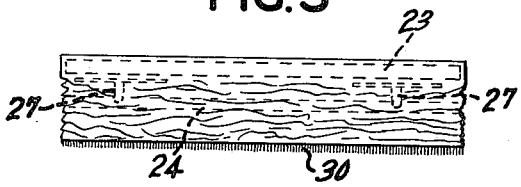
FIG. 3 is a side elevation of the container of this invention in its fully collapsed state.
Figure 4:
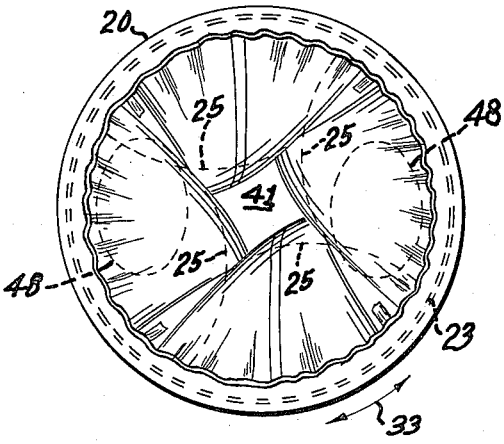
FIG. 4 is a top plan view of the container of this invention in its fully collapsed state.

The container is capable of being fully collapsed to be stored in a small place as illustrated in FIGS. 3 and 4. In its fully collapsed position the side view of the container is that shown in FIG. 3 in which the upper portion of the container body 20 has also been collapsed similar to the lower portion 26 shown in FIG. 2. The collapsing of the upper portion of container body 20 is accomplished by simply rotating hoop 23 in either of the directions shown by arrow 33 while maintaining hoop 24 in a relatively fixed position. Such a rotation causes the upper end of stiffening members 25 to follow the motion of hoop member 23 while the lower end of stiffening members 25 remains relatively fixed along with hoop member 24. This rotational motion results in the folding of the walls of container 20 and of stiffening members 25 into the general position shown in FIG. 4. In this fashion a container which might measure 30–50 inches in height in the open position shown in FIG. 1 can be collapsed to a height of 3–6 inches in the position shown of FIG. 3. The change from a collapsed position to an open position or the reverse can be accomplished almost instantaneously.

Figure 5:
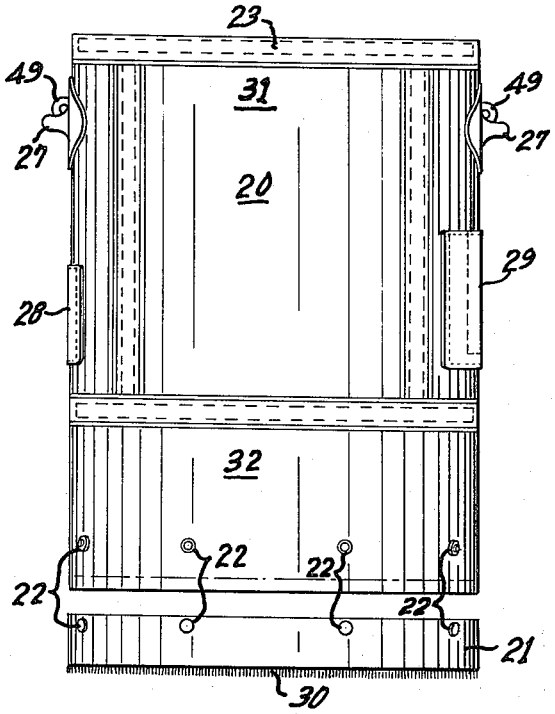
FIG. 5 is an exploded side elevation view of the container of this invention as shown as in FIG. 1.

In FIG. 5 there is shown an exploded view of the container of FIG. 1. This view merely indicates how fastener elements 22 may be attached to the bottom end 32 of container body 20 and a corresponding portion of the fastener 22 may be affixed to bottom cover 21 so that the two fastening elements may cooperate to attach bottom cover 21 or detach bottom cover 21 from container body 20. This construction permits the installation of a new cover to an old container body if the cover should become worn, or the reverse if the body is worn.

Figures 6, 7, 8, 9, 10, 11, 12:
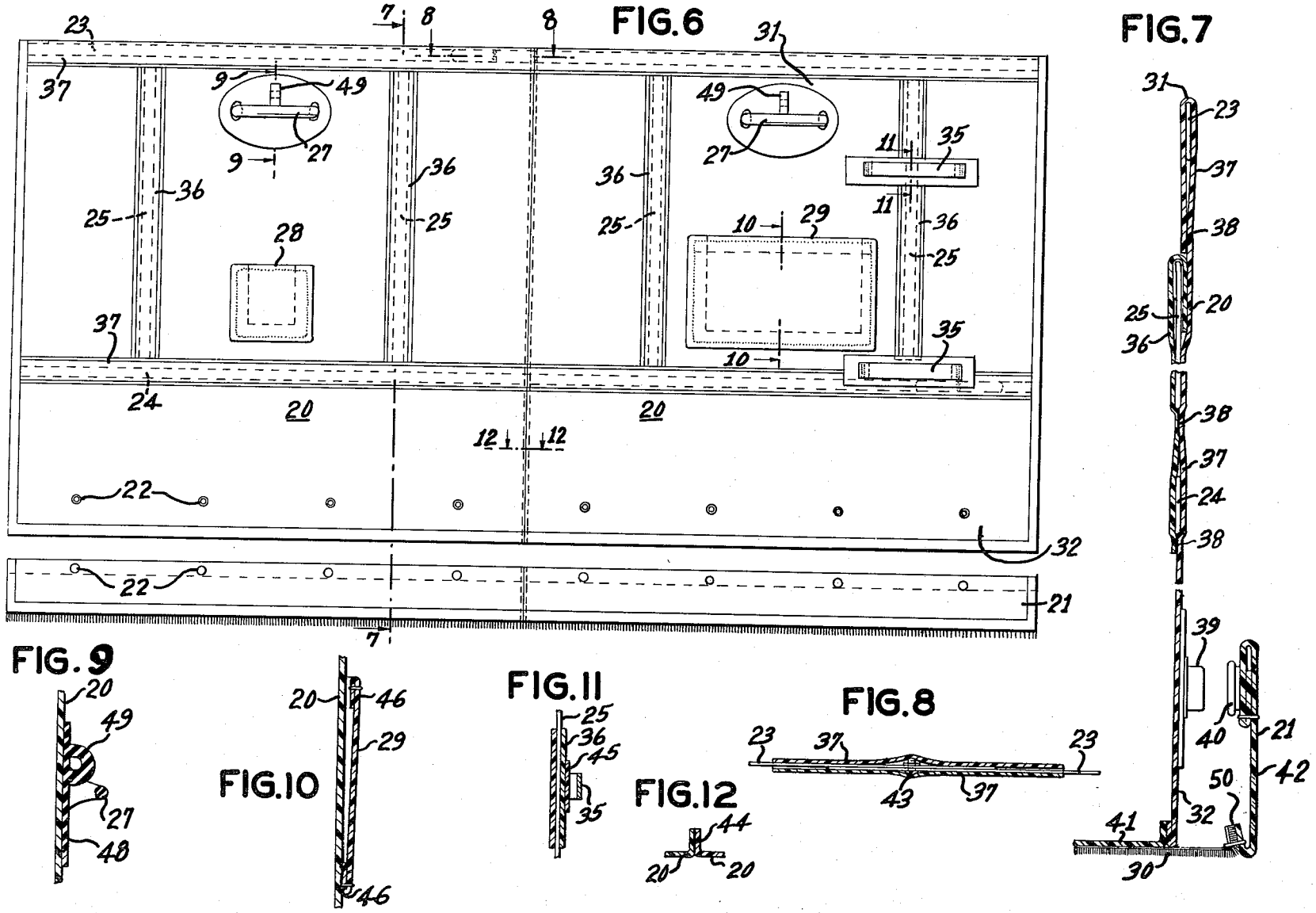
FIG. 6 is a development view of the container of this invention.
FIG. 7 is a cross sectional view taken along 7—7 of FIG. 6.
FIG. 8 is a cross sectional view taken along 8—8 of FIG. 6.
FIG. 9 is a cross sectional view taken along 9—9 of FIG. 6.
FIG. 10 is a cross sectional view taken along 10—10 of FIG. 6.
FIG. 11 is a cross sectional view taken along 11—11 of FIG. 6.
FIG. 12 is a cross sectional view taken along 12—12 of FIG. 6.

In FIG. 6 there is shown a development of the container body and cover. This illustrates how container body 20 may be fabricated from a sheet of material. Adjacent the top end 31 of container body 20 there is fabricated a tubular pocket 37 to contain hoop 23. Intermediate the top end 31 and the bottom end 32 of container body 20 there is fashioned another tubular pocket 37 to contain a hoop member 24. The vertical distance between hoops 23 and 24 is approximately the diameter of container body 20. Substantially perpendicular to pockets 37 and spaced substantially equidistant from each other are fabricated pockets 36 to contain separate vertical stiffening members 25. Preferably four stiffening members 25 are employed spaced substantially equidistantly around container body 20, although more or less than four may be employed in certain embodiments of this invention. In order for the container to be useful in carrying cleaning tools that might be needed there can be included in the outside wall of container 20 one or more small pockets 28 and one or more large pockets 29 as well as keeper loops 35. Pockets 28 and 29 may, for example, be used to carry cleaning fluids small brushes, or the like. Keeper loops 35 may be employed to hold brooms, mops, etc. by inserting the handle of such implements through corresponding top and bottom loops 35. The container should also have handles for moving the container about, and accordingly, two handles 27 are fabricated into container body 20.

FIG. 7 illustrates the construction of the wall of container body 20 and bottom cover 21. Two pockets 37 are made, the upper one by doubling over the wall of container body 20 and sealing by heat and other means at 38 to produce the upper pocket 37 for enclosing hoop member 23; the lower one by a separate piece of material secured to container body 20 to produce the lower pocket 37 for enclosing hoop member 24. Intermediate these hoop members are pockets 36 made by sealing additional portions of the same material from which the wall of container 20 is made, and such pockets serve to enclose vertical stiffening members 25. On the lower portion of container body 20 there is affixed by riveting, cementing, or the like male fastener portion 39. The bottom of container body 20 is closed by a circular bottom closure member 41 which is heat sealed, cemented, or otherwise attached at its perimeter to body 20, preferably with a liquid impermeable seal. Bottom cover 21 is a cup-shaped piece formed from skirt portion 42 and a circular wear surface 30 made of carpeting. These two pieces are joined together at 50 by stitching, stapling, or the like. Skirt or circumferential portion 42 of cover 21 is preferably made of the same material as that of the wall of container body 20. At the upper extremity of skirt 42 the female fastener portion 40 is affixed to a doubled over backing of skirt 42. Outer wear surface 30 is preferably made of synthetic carpeting material having high wear resistance and low friction so that the entire container may be dragged across the floor without undue effort and without fear of tearing the bottom surface.

In FIG. 8 there is shown how a straight piece of metallic strip is fashioned into a band or hoop 23. The two ends of the strip are brought together and riveted or otherwise fastened at 43 and the area around fastening 43 is covered by suitably enlarged portions of tubular pocket 37.

In FIG. 9 there is shown the attachment of handle 27 to the wall of container body 20 which is accomplished by employing a reinforcing base 48 cemented or sealed to the wall of container 20. In certain embodiments of this invention it may be desirable to include along with handle 27 a rope loop 49 fastened to base 48. Loop 49 may be employed for any of several purposes such as fastening the container to a heavy object to prevent it from being moved, or to contain a circle of rope around the container to serve as a convenient handle for dragging the container from place to place.

FIG. 10 shows the construction of pockets 28 or 29 in which an appropriate additional piece of material is sealed to container wall 20 with doubled edges 46 and with suitable sealing or other means to attach the pocket to container body 20.

FIG. 11 illustrates the attachment of keeper loops 30 to container body 20 at pocket 36 which encloses vertical stiffening member 25. Loop 35 may be made of the same material as container body 20 or any other suitable materials which can be attached thereto.

FIG. 12 shows the method of fabricating a flat sheet material to form a cylindrical body by forming a seam 44 where two corresponding portions of container body 20 meet. Such a seam may be suitably made by sewing, sealing, stapling, or the like.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A collapsible and flexible container comprising a generally thin walled cylindrical body having an upper end and a lower end, said body being made of collapsible and flexible sheet material, a removably attachable bottom cover, and fastening means for removably attaching said cover to said lower end of said body, said cover having an outside surface of wear resistant, low friction material, said body enclosing in its wall adjacent said upper end a first circumferential stiff hoop and spaced intermediate of said upper and lower ends a second circumferential stiff hoop substantially parallel to said first hoop, said body also enclosing in its wall a plurality of spaced stiffening members substantially perpendicular to and separated from said hoops and positioned intermediate of said first and second hoops.

2. The container of claim 1 wherein said body is made of plastic.

3. The container of claim 2 wherein said plastic is a laminate of polyvinyl chloride and nylon fiber.

4. The container of claim 1 wherein said cover comprises a circumferential portion of a laminate of polyvinyl chloride and nylon fiber and a bottom portion of polypropylene carpeting.

5. The container of claim 1 where said hoops and said stiffening members are metallic strips.

6. The container of claim 1 wherein said body includes two flexible handles adjacent said upper end.

7. The container of claim 1 wherein said fastening means is a plurality of spaced snap fastener elements.

8. A vertically collapsible trash container in the shape of an open top barrel comprising a body portion, a bottom cover portion, and fastening means for removably attaching said cover portion to said body portion, said body portion including a thin flexible and collapsible cylindrical wall having a top end and a bottom end, said wall enclosing a first hoop member in a fixed position adjacent said top end and a second hoop member in a fixed position intermediate said top end and said bottom end in spaced parallel relationship with said first hoop member, said wall further enclosing a plurality of vertical stiffening members positioned between and substantially perpendicular to said hoop members and being discretely separated therefrom, said stiffening members being positioned substantially equidistant from each other around said wall.

9. The container of claim 8 wherein said wall is made of polyvinyl chloride laminated to nylon fiber.

10. The container of claim 8 wherein said bottom cover portion includes a bottom portion of an exposed carpet material and a circumferential portion of a laminate of polyvinyl chloride and nylon fiber.

11. The container of claim 8 wherein said hoop members and said stiffening members are metallic strips.

12. The container of claim 11 wherein said metallic strips are steel.

13. The container of claim 8 wherein said body portion further includes two flexible handles affixed to said wall adjacent said top end.

14. The container of claim 8 wherein the distance between said hoop members is approximately the diameter of said cylindrical body portion.

15. A collapsible and flexible container adapted to receive trash having solids and fluids therein comprising a generally thin walled cylindrical body having an upper end and a lower end, said body being made of collapsible and flexible sheet material, a first circumferential stiff hoop attached to said body adjacent said upper end, a second circumferential stiff hoop substantially parallel to said first hoop and spaced intermediate of said upper and lower ends, a plurality of spaced elongated stiffening members attached to said body and extending substantially perpendicular to and separated from and positioned between said first and second hoops.

16. The container of claim 15 wherein said body is made of plastic.

17. The container of claim 15 further comprising a bottom cover attached to said body beneath said lower end.

18. The container of claim 15 further comprising a removably attached bottom cover beneath said lower end, and fastening means for removably attaching said cover to said lower end.

19. The container of claim 18 wherein said cover includes a substantially planar bottom and an upstanding skirt portion, said fastening means being connected between said skirt portion and the portion of said body adjacent thereto.

20. The container of claim 19 wherein said planar bottom includes an outer surface of wear resistant and low friction material.

* * * * *